United States Patent [19]

Peterson et al.

[11] 4,449,582

[45] May 22, 1984

[54] SEQUENCED PRODUCTION INCORPORATING FLUID ROD PUMP

[75] Inventors: Daniel G. Peterson, Los Angeles; John W. Erickson, Huntington Beach; Horace M. Robinson, Los Angeles, all of Calif.

[73] Assignee: Kobe, Inc., City of Commerce, Calif.

[21] Appl. No.: 410,300

[22] Filed: Aug. 23, 1982

[51] Int. Cl.[3] ..... E21B 43/00

[52] U.S. Cl. ..... 166/64; 166/65 R

[58] Field of Search ..... 166/64, 65 R, 66, 53, 166/54, 1, 250, 263; 175/24, 48; 417/46, 340, 344, 347, 302, 303, 122, 123

[56] References Cited

U.S. PATENT DOCUMENTS

| | | | |
|---|---|---|---|
| 2,034,798 | 3/1936 | Clark | 417/122 |
| 3,045,750 | 7/1962 | Peters et al. | 166/64 X |
| 3,921,152 | 11/1975 | Hagar et al. | 166/65 R X |
| 4,076,458 | 2/1978 | Jones | 417/46 |
| 4,125,163 | 11/1978 | Fitzpatrick | 166/53 X |
| 4,269,569 | 5/1981 | Hoover | 417/347 X |

*Primary Examiner*—James A. Leppink
*Assistant Examiner*—Thuy M. Bui
*Attorney, Agent, or Firm*—Norvell & Associates

[57] ABSTRACT

A surface power unit for use on a subterranean well generates a series of pulses of pressurized fluid to a downhole pump. A sequencing mechanism connects and disconnects the surface power unit to each of a plurality of downhole pumps in a predetermined order such that a pulse of pressurized fluid is being applied to one or more of the plurality of downhole pumps during a power cycle while each of the other ones of the plurality of downhole pumps is completing its pumping cycle. The number of downhole pumps which can be operated from a single surface power unit is limited by the ratio of the length of the power cycle to the length of the pumping cycle of the downhole pumps. The sequencing means can include a clocking device such as a shift register which generates a sequence of enabling signals to corresponding signal amplifiers for each well. Each amplifier generates an output signal to a solenoid actuated valve having an input connected to a common surface power unit and a fluid output connected to a downhole pump in an associated well. Each of the output lines from the shift register is connected to an input of an AND gate having another input connected to a pressure transducer which senses the end of the return stroke of the surface power unit cylinder.

8 Claims, 5 Drawing Figures

SEQUENCED PRODUCTION INCORPORATING FLUID ROD PUMP

CROSS-REFERENCE TO RELATED APPLICATION

This application is related in subject matter to copending application Ser. No. 298,122, filed Aug. 31, 1981, entitled "Combined Surface Power Unit and Velocity Actuated Valve for a Downhole Pump", said application being assigned to the same assignee as this application.

BACKGROUND OF THE INVENTION

1. Field of the Invention

The present invention relates to a pumping apparatus including a surface power unit and a sequencing unit for a plurality of downhole pumps positioned in individual wells.

2. Description of the Prior Art

Low pressure non-flowing wells account for the vast majority of the oil wells in the United States. There are various means available for pumping these non-flowing wells, including subsurface pumps which are electrically or hydraulically actuated. One problem which is common to both of these types of subsurface pumps is that a separate energy transmission path is required for supplying the actuating energy to the pumps.

There have been several attempts to provide a rodless subsurface pump system which does not require a separate energy transmission path for activating the pump. Such a pump system typically includes a surface unit which is connected to the subsurface pump by a single fluid conduit. This surface unit activates the subsurface pump by applying pressure to the fluid in the conduit so as to compress a spring means in a pump and displace a slidable piston, thereby drawing fluid from the well into a pump chamber. When the surface unit releases the fluid pressure, the spring means of the downhole pump displaces the piston and lifts the fluid in the pump chamber into the fluid conduit. Such systems are disclosed in U.S. Pat. Nos. 2,058,455, 2,123,129, 2,126,880, and 2,508,609.

Several problems, however, are inherently associated with these pressure-activated subsurface pump systems. Since thousands of feet typically separate the surface unit from the downhole pump, considerable work is done compressing fluid in the conduit, ballooning the conduit, and moving fluid to compress the subsurface pump spring. The energy applied in the fluid conduit system is much greater than the energy supplied to the subsurface pump. In these systems, considerably more energy is consumed in compressing the spring and ballooning the conduit than is used to lift the fluid. Thus, these systems are energy inefficient.

It would be desirable to provide a subsurface pump which has a relatively long stroke length such that more fluid could be produced for a given amount of energy input. Early subsurface pumps utilized strong helical compression springs as a means for lifting the fluid into the fluid conduit. Such springs severely limited the maximum stroke length which could be attained. Later subsurface pumps utilized an inert gas pressurized chamber which functions as a spring means. When pressure was applied to the fluid conduit, a piston compressed gas within the chamber and, when the fluid pressure was relieved, the gas expanded to lift the fluid into the conduit. Such a subsurface pump is disclosed in U.S. Pat. No. 4,013,385.

SUMMARY OF THE INVENTION

The present invention relates to a combined surface power unit and sequencing means for connecting and disconnecting the surface power unit to a plurality of downhole pumps in wells in sequence. The sequencing means connects the surface power unit to a selected one of the downhole pumps during a power cycle and disconnects the surface power unit from all of the downhole pumps between power cycles. The number of downhole pumps which can be operated from one surface power unit is determined by the ratio of the power cycle time to the pumping cycle time of the downhole pumps.

The sequencing means includes a clocking means for generating a series of enabling pulses, one enabling pulse for each downhole pump. The clocking means can include a shift register responsive to the surface power unit operation for generating the enabling signals in series. The enabling signals are amplified and applied as inputs to one of a plurality of valves, each valve being connected between the surface power unit output and a corresponding downhole pump. The enable lines from the shift register are each connected to one input of an AND gate having another input connected to an output of a pressure transducer. The pressure transducer senses the pressure at the output of the surface power unit and generates control signals. During the power stroke and the return stroke of a power cycle, the pressure transducer generates a high level control signal which enables the AND gates such that the enabling signal from the shift register is applied to the selected valve to connect the surface power unit to the selected downhole pump. At the end of the return stroke, the pressure transducer senses low pressure and generates a low level signal which disables all of the AND gates blocking the enable signal from the shift register between power cycles. Each low signal from the pressure transducer clocks the shift register to shift the enable signal to the next output.

In an alternate embodiment, a position transducer can be substituted for the pressure transducer. The position transducer senses the position of the piston in the surface power unit to generate the clocking signal to the shift register. A latching relay can be substituted for the AND gate and amplifier. The enable signal from the shift register actuates the corresponding relay which in turn actuates the associated valve. When the shift register is clocked, the actuated relay is reset.

DESCRIPTION OF THE PREFERRED EMBODIMENTS

Figure 1:
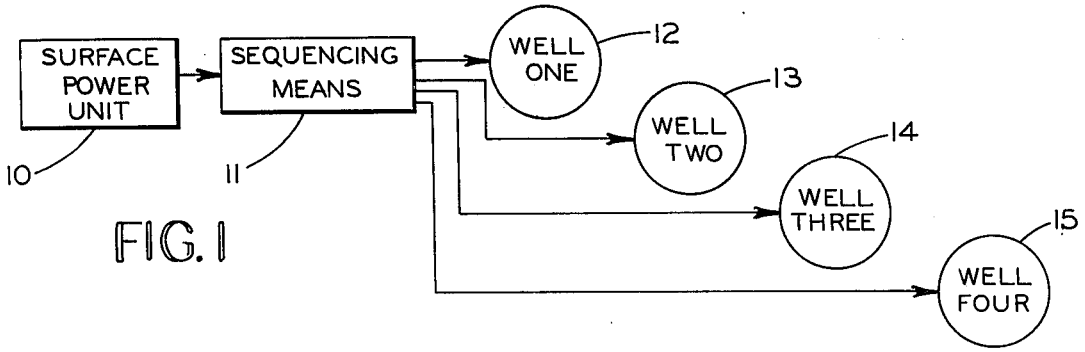
FIG. 1 is a block diagram of a surface power unit connected through a sequencing means to a plurality of wells in accordance with the present invention.

Referring now to the drawings, there is illustrated in FIG. 1 a surface power unit connected through a sequencing means to a plurality of wells in accordance with the present invention. The surface power unit and the downhole pumps located in the wells can be of the type found in the prior art or of the type disclosed in co-pending application Ser. No. 298,122, filed Aug. 31, 1981, entitled "Combined Surface Power Unit and Velocity Actuated Valve for a Downhole Pump" (KOBE-70-PA-US). In FIG. 1, a surface power unit 10 generates pulses of pressurized fluid during power cycles to a sequencing means 11. The sequencing means 11 senses the power cycles and directs each pressurized fluid pulse in order to one of a plurality of wells such as well one 12, well two 13, well three 14, and well four 15. After the fluid pulse is applied to well one 12, the downhole pump in the well 12 comprises a pumping cycle which is typically greater in length of time than the power cycle of the surface power unit 10. If, for example, the pumping cycle of the downhole pump is four times as long as the power cycle of the surface power unit, four downhole pumps can be sequenced in order to improve the efficiency of the surface power unit and downhole pump combination. Thus, while the downhole pump in the well 12 is completing its pumping cycle, the surface power unit is connected to the well 13, the well 14, and the well 15 in order. At the end of the fourth power cycle, which was applied to the well 15, the downhole pump in well 12 has completed its pumping cycle and is ready to receive another pressurized fluid pulse from the surface power unit 10.

Figure 2:
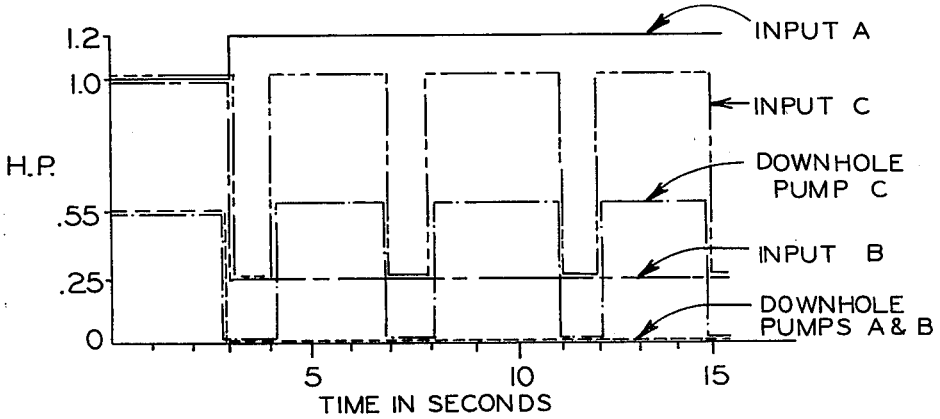
FIG. 2 is a graph of the horsepower input and output versus time comparing the present invention with two prior art devices.

There is shown in FIG. 2 a graph of horsepower versus time in seconds comparing the input horsepower and downhole pump output horsepower requirements for various surface power unit and downhole pump combinations. In example A, indicated as INPUT B in FIG. 2, a single surface power unit is connected to a single downhole pump. The graph in FIG. 2 is based upon an assumed fifteen second power and pumping cycle including a three second power stroke of the surface power unit, a one second recovery or return stroke of the surface power unit, a nine second pumping stroke of the downhole pump, and a two second recovery time for the downhole pump for a total of fifteen seconds.

In example A, the surface unit generates approximately one horsepower for three seconds and then switches to an idling mode at 1.2 horsepower for twelve seconds. The downhole pump does 0.55 horsepower of work during the three seconds of the power stroke and then does no work which requires an input from the surface power unit during the time it completes its return stroke and the rest periods for a total of twelve seconds. The efficiency of such a system can be calculated by multiplying the 0.55 horsepower times three seconds and dividing the product by the sum of the horsepower input of the surface power unit which is one horsepower times three seconds plus 1.2 horsepower times twelve seconds. Thus, the efficiency of this system is approximately 9.5%.

In example B, indicated as INPUT B in FIG. 2, the surface power unit output is reduced in an idling mode after the three second power stroke such that it operates at 0.25 horsepower for the remaining twelve seconds. The downhole pump operates in the same manner as the downhole pump in example A. Therefore, the efficiency of this system can be calculated by multiplying the 0.55 horsepower times three seconds and dividing by the sum of the one horsepower times three seconds and 0.25 horsepower times twelve seconds. This efficiency is 27.5%.

In example C, the surface power unit is cycled among four downhole pumps. Thus, the surface power unit has four power strokes of one horsepower for three seconds each and four recovery periods of 0.25 horsepower for a total of three seconds. Each of the downhole pumps does 0.55 horsepower of work for three seconds. Therefore, the efficiency can be calculated by multiplying the 0.55 horsepower times three seconds times the four downhole pumps and dividing the product by one horsepower for three seconds times the four power cycles plus 0.25 horsepower for three seconds for the recovery periods. The efficiency of this sequencing system is 51.8%.

Figure 3:
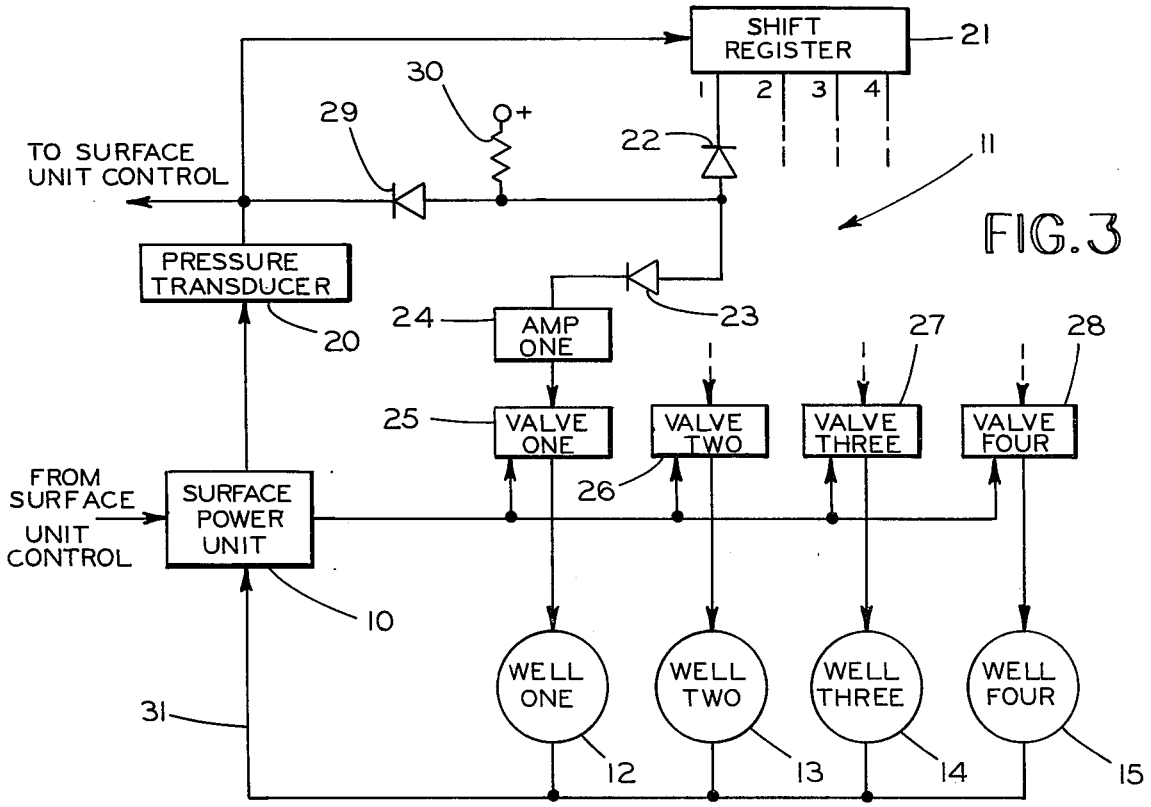
FIG. 3 is a schematic block diagram of the sequencing means shown in FIG. 1.

There is shown in FIG. 3 a block diagram of the sequencing means 11 of FIG. 1. A pressure transducer 20 generates a pulse train to a four bit shift register 21. The shift register 21 responds to the pulse train by generating a series of high level enabling signals, one enabling signal from each output in order. If four downhole pumps are to be operated, the shift register 21 can be a model MC14574 manufactured by Motorola, Inc. The shift register 21 has an output 21-1 connected through a pair of diodes 22 and 23 to an input of an amplifier one 24. The output 21-1 is connected to a cathode of the diode 22 which has an anode connected to the anode of the diode 23. A cathode of the diode 23 is connected to the input of the amplifier 24. The shift register 21 also has outputs 21-2, 21-3 and 21-4 which are each connected through a pair of diodes (not shown) to associated amplifiers (not shown) in a manner similar to the output 21-1.

The output from the pressure transducer 20 is connected to a cathode of a diode 29 having an anode connected to the junction of the diodes 22 and 23. A resistor 30 is connected between the junction of the three diodes and a positive potential power supply. The diodes 22 and 29 and the resistor 30 form a logic AND gate for generating a high logic level signal at their junction only when the output of the pressure transducer 20 and the output 21-1 of the shift register are both at a high logic level.

The amplifier 24 has an output connected to the solenoid input of a solenoid actuated valve one 25. The valve 25 has a fluid input connected to an output of the surface power unit 10 and a fluid outlet connected to the downhole pump in the well 12. Similar valves two 26, three 27 and four 28 are provided for the wells 13, 14 and 15 respectively.

Each of the valves 26, 27, and 28 is controlled by an associated amplifier (not shown) and AND gate (not shown) connected to the pressure transducer 20 and an associated one of the shift register outputs 21-2, 21-3 and 21-4. An output from each of the wells 12 through 15 is connected to the surface power unit 10 by a return or production line 31. As each of the valves 25 through 28 is actuated in turn, production fluid is pumped from the associated well into the line 31.

Figure 4:
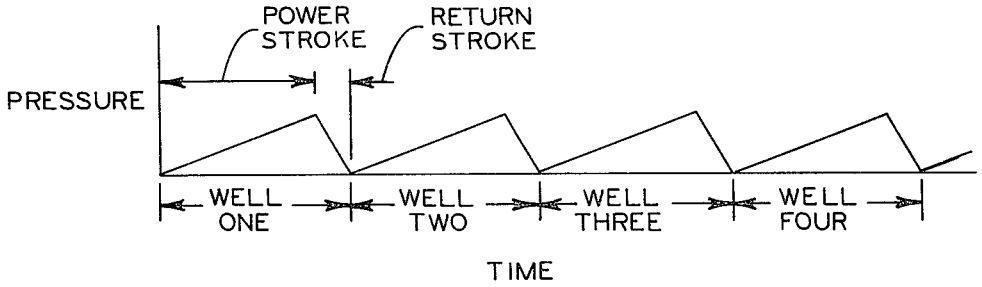
FIG. 4 is a graph of the well pressure versus time for the wells of FIGS. 1, 3 and 5.

There is shown in FIG. 4 a graph of the pressure applied to the wells versus time. The surface power unit 10 begins a power stroke at a low pressure level and ends the power stroke at a high pressure level. At the end of the power stoke, a return stroke is started which ends at the low pressure level. During the power stroke and the return stroke, the pressure transducer 20 generates a high level signal which reverse biases the diode 29 and the diodes in the other AND gates to enable the AND gates. If the shift register is generating a high level enable signal at the output 21-1, the diode 22 will be reverse biased and the power supply and resistor 30 will generate a high level signal through the diode 23 to enable the amplifier 24. The amplifier 24 will be turned on to actuate the valve 25 and connect the surface power unit 10 to the well one 12.

At the end of the return stroke, the low pressure is sensed by the pressure transducer 20 which generates a low level signal. The low level signal disables all of the AND gates to disconnect all of the wells from the surface power unit 10. The low level signal also clocks the shift register 21 and the high level enabling signal is shifted to the output 21-2. The other outputs of the shift register generate low level signals. As the pressure builds on the next power stroke, the pressure transducer 20 switches to generate a high level signal to again enable all of the AND gates. The AND gate connected to the output 21-2 will generate an enabling signal and the valve two 26 will be actuated to connect the surface power unit 10 to the well two 13. The system will continue to cycle in this manner through the predetermined sequence of well connections.

Although a shift register is shown, the means for generating the actuating signal could be implemented with equivalent electromechanical elements such as a motor driven set of four switches. The amplifier 24 can be a model SN75468 manufactured by Texas Instruments.

It will be appreciated that the sequencing means increases the efficiency of a fluid rod pump system wherein a plurality of wells are located close enough to each other such that the losses in the lines between the surface power unit and the downhole pumps do not exceed the increase in the efficiency over the prior art surface power unit/downhole pump units. Also the use of one surface unit to operate a plurality of downhole pumps is a cost and space effective means of producing these wells.

Figure 5:
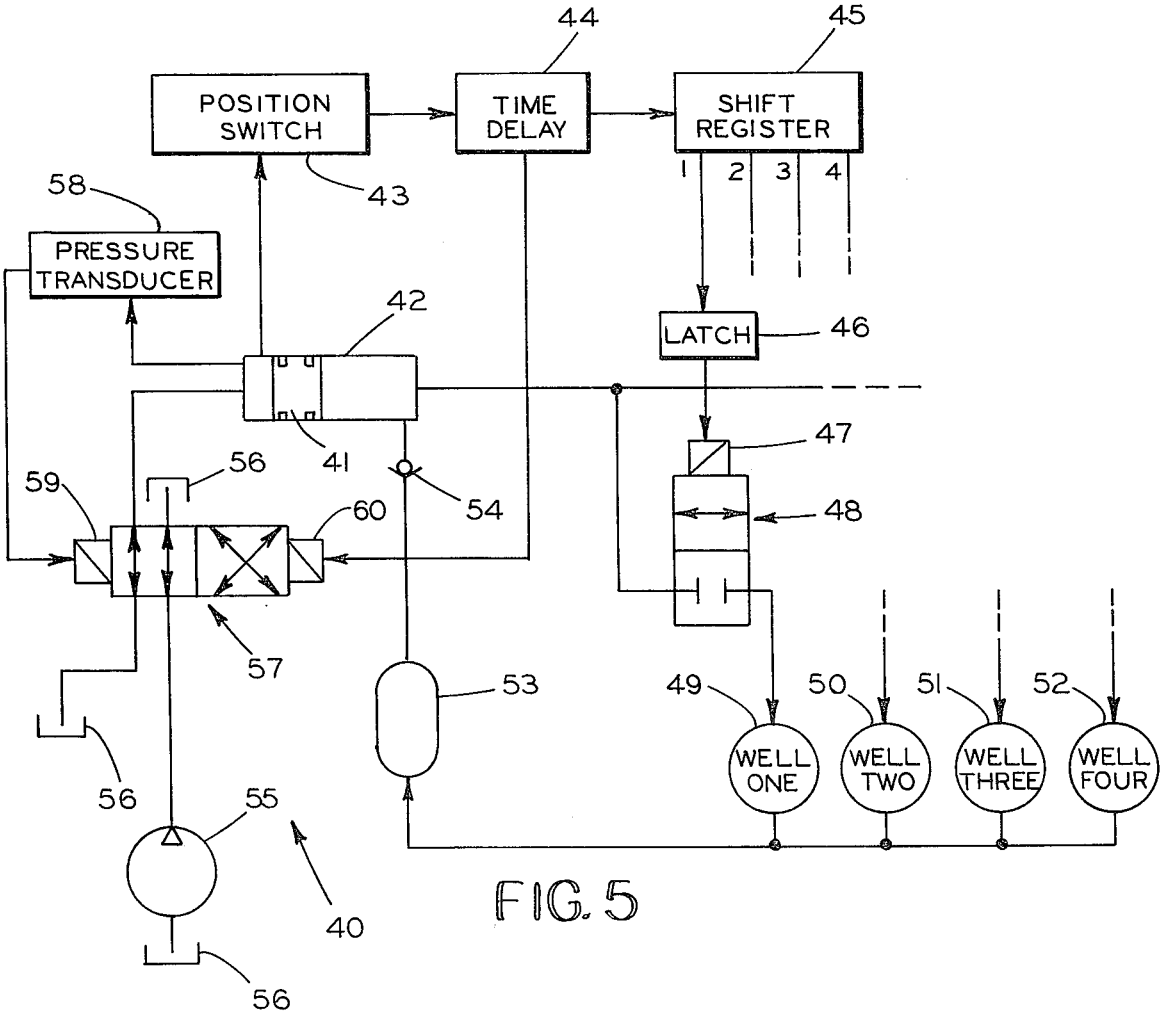
FIG. 5 is a schematic block diagram of an alternate embodiment of the sequencing means shown in FIGS. 1 and 3.

There is shown in FIG. 5 an alternate embodiment of the present invention. A surface power unit 40 includes a piston 41 slidably movable in a cylinder 42. A position switch 43 monitors the movement of the piston 41 to generate a first control signal when the piston reaches the end of the return stroke and to generate a second control signal in all of the other positions of the piston 41. An output of the position switch 43 is connected to an input of the time delay 44 having a pair of outputs. A first output of the time delay is connected to an input of a shift register 45 having outputs 45-1, 45-2, 45-3 and 44-4. The output 45-1 is connected to an input of a lock-in or latching relay 46. Although not shown, each of the other shift register outputs is also connected to an input of an associated relay.

An output of the latch relay 46 is connected to a solenoid 47 of a solenoid actuated valve 48. The valve 48 has a pair of normally closed ports with one of the ports connected to an output of the cylinder 42 of the surface power unit 40 and the other one of the ports connected to an input of well one 49. Although not shown, each of the latches connected to the outputs 45-2, 45-3 and 45-4 have outputs connected to solenoids of solenoid operated valves connected between the output of the cylinder 42 and the inputs of well two 50, well three 51, and well four 52. The output from each of the wells is connected to a production line which is an input to a fluid accumulator 53. An output of the fluid accumulator 53 is connected through a check valve 54 for fluid flow to the output side of the cylinder 42.

A pump 55 is connected between a source of fluid 56 and one port 57-1 of a solenoid operated four-way valve 57. A port 57-2, and port 57-3 of the valve 57 are both connected to the same fluid source 56. A port 57-4 is connected to the input side of the cylinder 42. A pressure transducer 58 is connected between the cylinder 42 and a solenoid 59 of the valve 57. The second output of the time delay 44 is connected to a solenoid 60 of the valve 57.

If it is assumed that the piston is near the end of the return stroke for well four 52, the valves 48 and 57 will be connected in the manner shown in FIG. 5. When the piston 41 reaches the end of the return stroke, the position switch 43 generates a signal through the time delay 44 to clock the shift register 45 thereby switching the enabling signal from the output 45-4 to the output 45-1. The enabling signal at the output 45-1 will actuate the latch 46 which in turn actuates the solenoid 47. The normally closed ports of the valve 48 will be open to connect the output of the cylinder 42 to the input of the well one 49. After a suitable time delay to enable the valve 48 to be actuated and the valve connected to well four 52 to be opened, the time delay 44 generates a signal from its second output to the solenoid 60 of the valve 57. The valve 57 is actuated to connect the port 57-1 to the port 57-4 thereby applying pressured fluid from the motor 55 to the cylinder 42 to begin the power stroke of piston 41. The ports 57-2 and 57-3 will be connected to the fluid source 56.

At the end of the power stroke, the pressure transducer 58 will generate a signal to the solenoid 59 to switch the valve 57 to the position shown. Now the pressurized fluid in the well one 49 will go back through the valve 48 to the cylinder 42 forcing the piston 41 to return toward the position shown in FIG. 5 thereby forcing fluid through the ports 57-3 and 57-4 to the fluid source 56. At the end of the return stroke of the piston 41, the position switch 43 will again generate its signal to clock the shift register to enable the valve for the well two 50 and disable the valve for the well one 49 to begin the cycle for valve two 50. Thus, in the system shown in FIG. 5, the lock-in or latching relay 46 replaces the AND gate and amplifier utilized in the system shown FIG. 3. The position switch 43 shown in FIG. 5 can be utilized in place of the pressure transducer 20 shown in FIG. 3. The surface power unit 40 of FIG. 5 including the elements 41, 42 and 53 through 60 can be utilized for the surface unit 10 of FIG. 3.

Although the invention has been described in terms of specified embodiments which are set forth in detail, it should be understood that this is by illustration only and that the invention is not neccesarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for pumping production fluid from a plurality of subterranean wells, a common source pump means, a plurality of downhole pump means with one of said downhole pump means in each of said wells, a plurality of valve means having input and output means, means connecting said common source pump means to the input means of each of said valve means, means for connecting the output means of one of said valve means to one of said downhole pump means for each of said plurality of downhole pump means, means for generating sequential electronic signals for enabling each of valve means in a predetermined sequence, means for connecting one of said enabling signals to one of said valve means for each of said plurality of valve means, each of said valve means being responsive to an associated one of said enabling signals to connect said common source pump means to said downhole pump means in said predetermined sequence to produce cycles of pressurized fluid, and means for disabling said enabling signals connected to said means for connecting said enabling signals.

2. The apparatus according to claim 1 including means responsive to the operation of said common source pump means for generating a first signal when the pressurized fluid is at a predetermined minimum value and a second signal when the pressurized fluid is above said predetermined minimum value and means responsive to said first signal for blocking said enabling signals from said valve means and responsive to said second signal for passing said enabling signals to said valve means.

3. The apparatus according to claim 2 wherein said means for generating said first and second signals includes a pressure transducer connected to said pump means for sensing the pressure of fluid from said downhole pump means to generate said first signal as a low level voltage and said second signal as a high level voltage; and said means responsive to said first and second signals includes an AND gate individual to each of said output lines, said AND gates being responsive to said second signal and an associated one of said enabling signals for actuating an associated one of said valve means.

4. The apparatus according to claim 1 including a signal amplifier individual to each of said valve means and connected between said means for generating said enabling signals and said valve means for amplifying said enabling signals.

5. The apparatus according to claim 1 including a latching relay individual to each of said valve means and connected between said means for generating said enabling signals and said valve means and responsive to an associated one of said enabling signals for actuating said valve means to connect said pump means to the downhole pump.

6. The apparatus according to claim 1 including means for generating a clock signal at the end of each one of said cycles of pressurized fluid, said means for generating an enabling signal being responsive to said clock signals for generating said enabling signals in said predetermined sequence, and means responsive to said clock signal for delaying the start of each one of said cycles of pressurized fluid until the corresponding enabling signal is generated.

7. An apparatus for pumpimg production fluid from a plurality of subterranean wells comprising: a pump means as a source of pressurized fluid, a downhole pump means in each well, a plurality of valve means, each of said means connected between said pump means and a corresponding one of each of said downhole pump means, said valve means generating cyclic pulses of pressurized fluid to an inlet of each of the downhole pump means, and electronic means generating an enabling signal for each of said valve means in a predetermined sequence, each of said valve means being responsive to an associated one of said enabling signals for connecting said pump means to the downhole pumps in said predetermined sequence whereby a plurality of downhole pumps can be operated from a single-source pump by operating each pump during the time following the lifting part of the cycles of the other pumps, thereby increasing the efficiency of the pumping system.

8. The apparatus of claim 7 and means connected to said pump means responsive to the operation of said pump means for generating a first signal when the pressurized fluid is at a predetermined minimum valve and a second signal when the pressurized fluid is above said predetermined value, and means responsive to said second signal for generating said enabling signals in sequence.

* * * * *